United States Patent [19]

Tipler

[11] 4,103,946

[45] Aug. 1, 1978

[54] FLUSH SET LOCK FOR SLIDING DOORS

[75] Inventor: Donald Henry Tipler, Hunts, England

[73] Assignee: Schlegel (UK) Limited, Leeds, England

[21] Appl. No.: 762,583

[22] Filed: Jan. 26, 1977

[30] Foreign Application Priority Data

Jan. 29, 1976 [GB] United Kingdom ..... 3518/76

[51] Int. Cl.[2] ..... E05C 5/00; E05C 19/12

[52] U.S. Cl. ..... 292/114; 70/99; 292/108; 292/128; 292/DIG. 46

[58] Field of Search ..... 292/67, 64, 63, 114, 292/128, 95, 107, 103, 106, 108, 145, 147, 150, 153, DIG. 46; 70/99, 95

[56] References Cited

U.S. PATENT DOCUMENTS

| | | | |
|---|---|---|---|
| 2,736,185 | 2/1956 | Collar | 292/106 X |
| 3,040,555 | 6/1962 | Wartian | 292/DIG. 46 X |
| 3,198,564 | 8/1965 | Welsh | 292/DIG. 46 X |
| 3,353,855 | 11/1967 | Smith | 70/95 X |
| 3,437,364 | 4/1969 | Walters | 292/106 X |

FOREIGN PATENT DOCUMENTS

| | | | |
|---|---|---|---|
| 1,396,876 | 6/1975 | United Kingdom | 292/DIG. 46 |

*Primary Examiner*—Roy D. Frazier
*Assistant Examiner*—William E. Lyddane
*Attorney, Agent, or Firm*—George W. Shaw

[57] ABSTRACT

A bolt mechanism for a sliding door or the like has a body having a rectilinear slideway for slidably receiving a first member, which has a manually operable means for sliding the first member between a closing position and an open position. A second member is pivotally connected to the first member and has a bolt portion laterally offset from, but projecting generally parallel, to the path of the member in the slideway for engagement with a keeper or strike plate mounted on the door jam. The bolt mechanism has an adjusting means readily accessible from the edge of the door whereby the position of the bolt may be adjusted to accommodate minor variations in the relative positions of the bolt mechanism and the keeper from installation to installation.

12 Claims, 2 Drawing Figures

FLUSH SET LOCK FOR SLIDING DOORS

The present invention relates to bolt mechanisms and in particular to bolt mechanisms for sliding doors and the like.

Previously known bolt mechanisms for sliding doors have various disadvantages such as absence of means for adjusting the bolt portion disposition to cater for minor variations in the relative dispositions of the bolt mechanism and the keeper from site to site, or at best only providing for adjustment by means of difficult or complex operations. Another disadvantage encountered in prior art bolt mechanisms is that if the bolt should be locked in its closed position whilst the door is still open, there is a serious risk of damage to the bolt mechanism when the door is slammed shut and the bolt strikes the keeper.

It is an object of the present invention to provide an improved bolt mechanism which minimises such disadvantages.

The present invention provides a bolt mechanism for a sliding door or the like comprising a body having a rectilinear slideaway for slidably receiving a first member, which has a manually operable portion for sliding the first member between a closing position and an open position and a second member pivotally connected to the first member and having a bolt portion laterally offset from but projecting generally parallel to the path of the member in the slideway and means for holding said second member with its bolt portion in a closing position; and a locking element mounted on the body and manually movable when the first member is in its closing position, into and out of a locking position preventing return movement of the first member to its open position.

Adjustment of the disposition of the closed position of the bolt portion may be effected by rotation of the second member about its pivotal mounting and adjustment of the means for holding the bolt portion in a closed position, so as to hold the second member and its bolt portion in a new closed position, rotationally displaced from its original closed position.

To avoid damage to the bolt mechanism upon the bolt portion striking a keeper when the bolt portion is in its closing position and the locking element is in its locking position, the holding means is arranged for releasably holding the second member with its bolt portion in its closed position and the bolt portion is configured, so that when the bolt portion strikes the keeper it is rotationally displaced towards its open position. Conveniently the holding means comprises resilient biasing means which urge the second member against a rotational stop when the second member is in its closed position.

Further advantages will become apparent from the following description of an embodiment of the present invention, which embodiment is described with reference to the accompanying drawings wherein.

Figure 1:
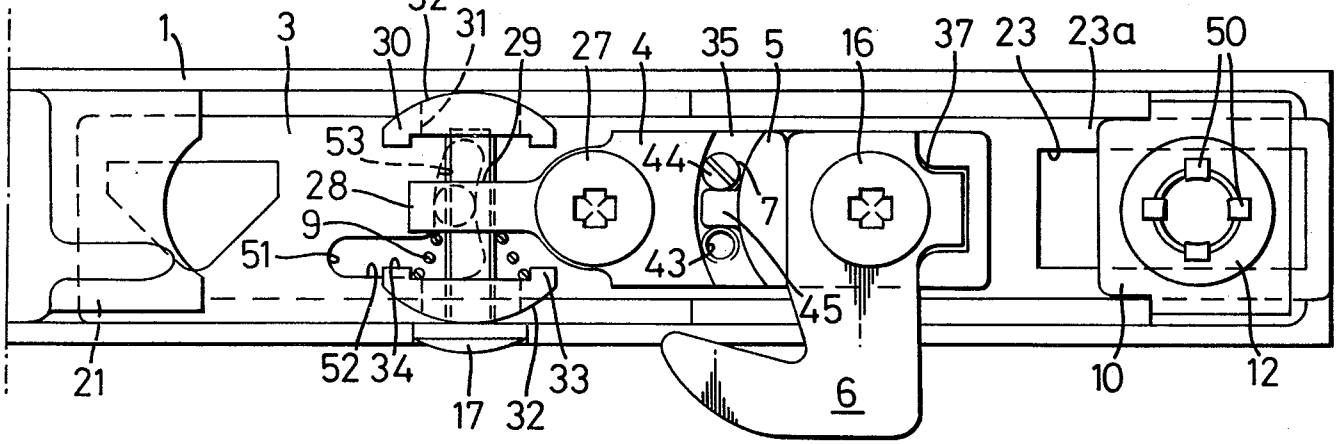
FIG. 1 is a plan view of a bolt mechanism.
Figure 2:
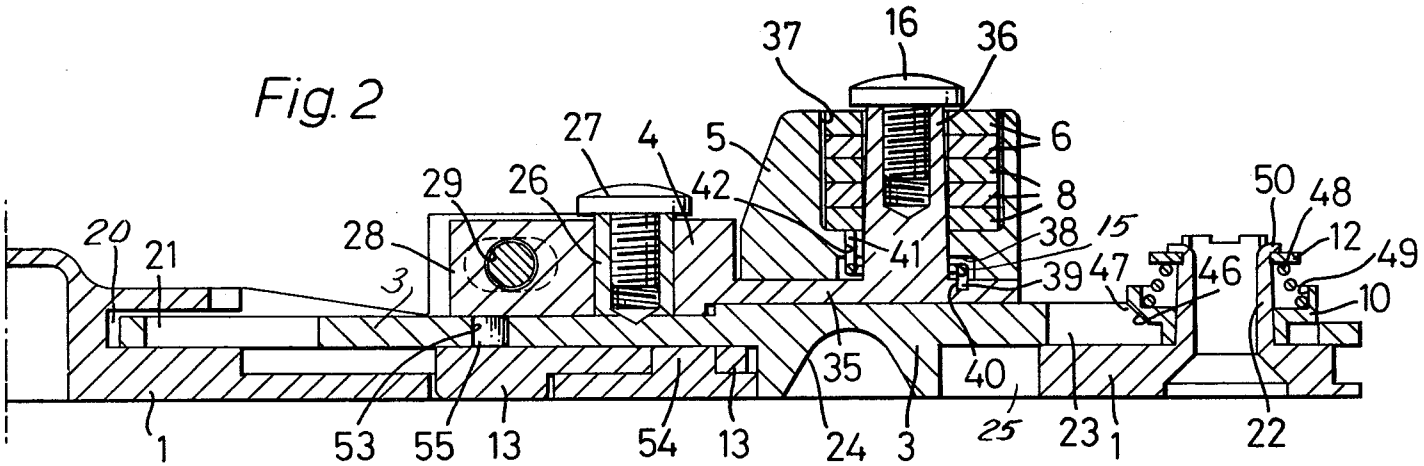
FIG. 2 is a longitudinally sectioned side view of the bolt mechanism of FIG. 1 taken about the longitudinal center of the bolt mechanism.

In the drawings is shown a first body part 1 of a bolt mechanism (other body part not shown in the drawings). A substantially rectangular member 3 is slidably located in a rectilinear slideway defined by, inter alia, a recess 20 in the body part 1 for receiving a first end 21 of member 3 and by a boss 22 extending from body part 1 through a rectangular aperture 23 in the second end **23*a* of member 3. The member 3 also has on one face an operating portion 24 disposed through a rectangular aperture 25 in body part 1** so that it can be operated manually and slid to and fro within its rectilinear slideway.

The member 3 has on its opposite face a boss 26 on which is pivotally mounted a swivel member 4 which is retained in position by a screw 27 screwed into the boss 26. At one end of the second or swivel member 4 is a longitudinally extending limb 28 having a transverse screw threaded hole 29. Extending upwardly from the member 3 on either side of said limb 28 are stop means or flanges 30 each having an elongated slot 31 having a longitudinal axis extending generally parallel to the longitudinal axis of the member 3. Each flange or collar 30 has a part-cylindrical outer surface 32 and a rim 33 projecting from its inwardly disposed surface 34. A second member engagement means or screw 17 passes through one of the slots 31 and is screwed into the screw threaded hole 29 of limb 28. A resilient biasing means comprising a coil spring 9 is located around the screw 17 and between the limb 28 and the inner face 34 of the flange or collar 30 on which it is located by rim 33.

The other end of the swivel member 4 comprises a plate 35 having an upstanding boss 36 on which is pivotally mounted a bolt retainer 5.

The bolt retainer 5 has a recess 37 for receiving two bolt elements 6 and three spacer elements 8, said recess and each of said elements also extending about the boss 36. The bolt retainer 5 and elements 6 and 8 are retained in position by a screw 16 which is screwed into the boss 36. A further recess 38 in the bolt retainer 5 opposite recess 37 receives a spring 15 disposed about boss 36 and having one end 39 located in a bore 40 in plate 35 and its other end 41 located in a bore 42 extending from recess 38 to recess 37.

Plate 35 also has two grub screw holes 43 disposed on either side of the longitudinal axis of swivel member 4. The projecting head 44 of a grub screw 7 located in one of the grub screw holes 43 acts as a stop for a nose 45 of bolt retainer 5.

A wedge plate 10 is disposed about boss 22 and has an inclined surface 46 which co-operates with an inclined surface 47 in member 3 on either side of aperture 23 to raise wedge plate 10 when said inclined surfaces 46, 47 are slid over one another, against the bias of a coil spring 48 which has one end located in a recess 49 in wedge plate 10 and its other end located against a washer 12 which is retained in position about said boss 22 by turned over portions 50 of the boss 22.

At its opposite end, the first body part 1 has a substantially "L" shaped slot 51 having a first arm 52 parallel to the longitudinal axis of the first body part 1 and a second arm 53 transverse to said longitudinal axis and slightly arcuate in configuration. A locking element 13 is pivotally mounted on a boss 54 provided on said first body part 1 and has a projection 55 slidably located in the "L" shaped slot 51.

When the member 3 with the bolt elements 6 is in a closed position, the locking element 13 is rotatable about boss 54 with the projection 55 slidable within the arcuate limb 53 of the slot 51. Rotation of the locking element 13 so that its projection 55 is located at the closed end of the arcuate arm 53 locks member 3 in its closed position. To unlock member 3, locking element 13 is rotated so that its projection is located in the angle of the "L" shaped slot 51. The member 3 is then slidable to and fro with the longitudinal arm 52 of the "L" shaped slot 51 sliding to and fro about the projection 55 of the locking element 13.

When the member 3 is slid from its closed position to its open position, the inclined surface 46 of wedge element 10 slides up inclined surface 47 of member 3 so that the wedge element 10 is raised up from body part 1 against the force of the coil spring 11 until the wedge element rests on an upper surface 56 of member 3. The force of the coil spring 11 on the wedge element 10 then acts to provide a resistance to return movement of the member 3.

Screwing or unscrewing of screw 17 into and out of limb 28 of the swivel member 4 causes the swivel member 4 and the bolt elements 6 attached thereto to rotate about boss 26. As the swivel member 4 rotates about boss 26, the screw 17 is moved within slot 31 of flange 30 and its head moves over the part cylindrical outer surface 32 of the flange 30. The spring 9 acts to hold the swivel member in position with the head of the screw 17 fast against the outer cylindrical surface 32 of the flange 30.

The bolt retainer 5 with its bolt elements 6 and spacer elements 8 (which are interchangeable with one another to provide for adjustments of the bolt position relative to the plane of the member 3) are held in position with the nose 45 held against the grub screw 7 by the force of the coil spring 15. When the bolt elements 6 strike the keeper (not shown) as may happen when the member 3 is inadvertently left in the closed position and an attempt is made to close the door, the bolt retainer 5 and bolt and spacer elements 6, 8 rotate about boss 36 away from grub screw 7 against the force of the coil spring 15 until the bolt element 6 clears the keeper whereupon bolt retainer 5 and bolt and spacer elements 6, 8 return to their original positions with the nose 45 fast against grub screw 7. thereby preventing damage to the bolt mechanism. It will also be appreciated that further impact absorption is provided by rotation of the swivel member about boss 26 against the force of coil spring 9.

In addition to the bolt mechanism being protected against damage upon impact of the bolt elements 6 on the keeper and to the adjustability provided by the swivel member 4 and screw 17, it will be apparent from the above description and the accompanying drawings that the construction of the various parts of the bolt mechanism is such that they may be readily interchanged in their positions to provide for either left-handed or right-handed operation. Thus in the case of the embodiment described hereinabove all that is required to provide for opposite-handed operation is to withdraw screw 17 and coil spring 9 and reinsert at the other flange 30; withdraw grub screw 7 and reinsert in the other grub-screw-hole 43; and to withdraw screw 16, turn over bolt elements 6 so that they project from the other side of the bolt mechanism and reinsert screw 16.

What is claimed is:

1. A bolt mechanism for use in a sliding door or the like for interengagement with a keeper, comprising:

a body having a rectilinear slideway with a closing position and an open position;

a first member located in said rectilinear slideway, said first member having manually operable means for sliding said first member between said closing and open positions and having second member pivotal mounting means;

a second member pivotally mounted on said first member by said second member pivotal mounting means, having engagement means and having a hook-shaped bolt means with a free end portion, said bolt means extending laterally from said second member with the free end portion projecting generally parallel to said rectilinear slideway;

second member holding means for holding the second member with its bolt means in a predetermined closing attitude, said second member holding means comprising resilient biasing means and second member stop means engageable by said second member engagement means, said resilient biasing means being arranged to urge said second member rotationally into said predetermined closing attitude defined by said second member stop means, at least one of said second member engagement means and said second member stop means having adjustment means for, respectively, adjusting the position of said second member engagement means on said second member and the position of said second member stop means, whereby said predetermined closing attitude of said second member with its bolt means is adjustable; and locking means mounted on said body and manually moveable when said first member is in said closing position, into and out of a locking position, said locking means when in said locking position preventing return movement of said first member to said open position, whereby said first member may be locked in said closed position.

2. The bolt mechanism of claim 1 wherein said second member stop means comprises a collar and said second member engagement means and said adjustment means comprises a holding screw having a head, said collar being mounted on said first member and said holding screw being disposed, through said collar, in screwthreaded engagement with said second member, said head of said holding screw abutting said collar in said closing position of said second member.

3. The bolt mechanism of claim 2 wherein said first member has two opposite sides with a said collar provided on each of said two opposite sides and said second member engagement means has two opposite sides each of said two opposite sides having screwthreaded location means screwthreadedly engageable by said holding screw, whereby said second member holding means may be positionally changed for left or right-handed operation according to whether said bolt means is arranged for left or right-handed operation of the bolt mechanism.

4. The bolt mechanism of claim 3 wherein said second member pivotal mounting means is disposed generally centrally of said second member and said second member has a first end and a second end, which ends are disposed to either side of said pivotal mounting means, second member engagement means being located at said first end and said bolt means being located at said second end.

5. The bolt mechanism of claim 4 wherein each said collar has an elongated aperature through which said holding screw is disposable.

6. The bolt mechanism of claim 4 wherein said second member has bolt means pivotal mounting means by means of which said bolt means is pivotally mounted on said second member and said bolt means pivotal mounting means includes resiliently displaceable bolt means holding means so that when said bolt means is struck in its closing attitude said bolt means is resiliently deflected inwardly of the bolt mechanism whereby said bolt mechanism is protected against damage.

7. The bolt mechanism of claim 6 wherein said bolt means holding means comprises resilient biasing means and bolt means stop means, said resilient biasing means being arranged to urge said bolt means rotationally against said bolt means stop means.

8. The bolt mechanism of claim 4 wherein said locking means comprises a substantially 'L' shaped slot in said first member, said 'L' shaped slot having a first longitudinal arm substantially parallel to the rectilinear slideway, a second arcuate arm and a corner common to said longitudinal and arcuate arms; and a locking element having locking element projection means, said projection means being arranged so as to be moveable, within said arcuate arm of said slot, into and out of said corner whereby when said locking element projection means is in said corner said first member is slideable between said open and closing positions whilst when said first member is in said closing position said locking element projection means is moveable out of said corner into said locking position.

9. The bolt mechanism of claim 7 wherein said second member has a screw receiving means, said bolt means stop means comprises a stop screw means having a head, said stop screw means being engaged in said screw receiving means so that said head projects from said second member, and said second member has a nose, which nose is rotationally urged against said stop screw means by said resilient biasing means.

10. The bolt mechanism of claim 9 wherein a said screw receiving means stop means may be positionally changed for left or right-handed operation according to whether said bolt means is arranged for left or right-handed operation of said bolt mechanism.

11. The bolt mechanism of claim 7 wherein restraining means are provided for yieldably resisting movement of said first member out of said open position whereby said first member is yieldably held in said open position.

12. The bolt mechanism of claim 8 wherein said restraining means comprise a friction plate resiliently biased against said first member and having a cam surface engageable with said first member so that said first member exerts a force on said friction plate which force is increased and decreased as said first member is moved into and out of its open position.

* * * * *